US009823014B2

(12) United States Patent
Duckett

(10) Patent No.: US 9,823,014 B2
(45) Date of Patent: Nov. 21, 2017

(54) METHOD OF COOLING BOIL OFF GAS AND AN APPARATUS THEREFOR

(75) Inventor: Alan Roderick Duckett, North Berwick (GB)

(73) Assignee: Babcock IP Management (Number One) Limited, London (GB)

( * ) Notice: Subject to any disclaimer, the term of this patent is extended or adjusted under 35 U.S.C. 154(b) by 527 days.

(21) Appl. No.: 14/111,639

(22) PCT Filed: Apr. 3, 2012

(86) PCT No.: PCT/GB2012/050750

§ 371 (c)(1),
(2), (4) Date: Dec. 31, 2013

(87) PCT Pub. No.: WO2012/143699

PCT Pub. Date: Oct. 26, 2012

(65) Prior Publication Data

US 2014/0102133 A1 Apr. 17, 2014

(30) Foreign Application Priority Data

Apr. 19, 2011 (GB) ..... 1106611.5
Nov. 3, 2011 (GB) ..... 1119013.9

(51) Int. Cl.
*F17C 3/10* (2006.01)
*F25J 1/00* (2006.01)
*F17C 13/00* (2006.01)

(52) U.S. Cl.
CPC ..... *F25J 1/0025* (2013.01); *F17C 13/004* (2013.01); *F17C 2221/01* (2013.01);
(Continued)

(58) Field of Classification Search
CPC ..... F25J 1/0025; F25J 2210/90; F25J 1/0022; F17C 13/004; F17C 2270/0105; F17C 2265/035; F17C 2265/034
See application file for complete search history.

(56) References Cited

U.S. PATENT DOCUMENTS 3,885,394 A 5/1975 Witt et al.
4,588,427 A * 5/1986 Yao ..... F25J 3/0209 62/634

(Continued)

FOREIGN PATENT DOCUMENTS

CN 1335475 A 2/2002
CN 1894535 1/2007

(Continued)

OTHER PUBLICATIONS

Machine Translation of Schmidt-Luessamnn (WO2010/108464).*

(Continued)

*Primary Examiner* — David Teitelbaum
(74) *Attorney, Agent, or Firm* — Flaster/Greenberg, PC

(57) ABSTRACT

The disclosure relates to a method and apparatus for cooling, preferably liquefying a boil off gas (BOG) stream from a liquefied cargo in a floating transportation vessel, said liquefied cargo having a boiling point of greater than −110° C. at 1 atmosphere and comprising a plurality of components, said method comprising at least the steps of: compressing a boil off gas stream (01) from said liquefied cargo in two or more stages of compression comprising at least a first stage (65) and a final stage (75) to provide a compressed BOG discharge stream (06), wherein said first stage (65) of compression has a first stage discharge pressure and said final stage (75) of compression has a final stage suction pressure and one or more intermediate, optionally cooled, compressed BOG streams (02, 03, 04) are provided between consecutive stages of compression; cooling the compressed BOG discharge stream (06) to provide a cooled vent stream (51) and a cooled compressed BOG stream (08); expanding, optionally after further cooling, a portion of the cooled compressed BOG stream (08) to a pressure between that of the first stage discharge pressure and the final stage suction pressure to provide an expanded cooled BOG stream (33);

(Continued)

heat exchanging the expanded cooled BOG stream (33) against the cooled vent stream (51) to provide a further cooled vent stream (53).

18 Claims, 6 Drawing Sheets

(52) U.S. Cl.
CPC *F17C 2221/035* (2013.01); *F17C 2223/0153* (2013.01); *F17C 2223/033* (2013.01); *F17C 2223/043* (2013.01); *F17C 2265/031* (2013.01); *F17C 2265/034* (2013.01); *F17C 2265/035* (2013.01); *F17C 2265/037* (2013.01); *F17C 2270/0105* (2013.01); *F25J 1/0022* (2013.01); *F25J 2210/90* (2013.01)

(56) References Cited

U.S. PATENT DOCUMENTS

| | | | | |
|---|---|---|---|---|
| 5,036,671 | A | 8/1991 | Nelson et al. | |
| 5,979,183 | A | 11/1999 | Smith et al. | |
| 2010/0058802 | A1* | 3/2010 | Brendeng | F25J 1/0022 62/612 |
| 2014/0123699 | A1 | 5/2014 | Duckett | |

FOREIGN PATENT DOCUMENTS

| | | | |
|---|---|---|---|
| CN | 101392980 | A | 3/2009 |
| DE | 3225300 | A1 | 1/1984 |
| DE | 3225300 | A1 | 1/1984 |
| EP | 0804360 | A1 | 4/2000 |
| EP | 1120615 | A2 | 8/2001 |
| GB | 1401584 | | 7/1975 |
| GB | 1472533 | A | 5/1977 |
| JP | S6224799 | | 2/1987 |
| JP | S62224799 | A | 10/1987 |
| JP | 2008286211 | A | 11/2008 |
| KR | 20080031611 | A | 4/2008 |
| KR | 20080081436 | | 9/2008 |
| KR | 20100108932 | | 10/2010 |
| WO | 96/22221 | | 7/1996 |
| WO | 01/59377 | A1 | 8/2001 |
| WO | 2005/047761 | A1 | 5/2005 |
| WO | WO-2005/047761 | A1 | 5/2005 |
| WO | 2010/093400 | A1 | 8/2010 |
| WO | 2010/108464 | A2 | 9/2010 |
| WO | WO-2010/108464 | A2 | 9/2010 |
| WO | 2011/002299 | A1 | 1/2011 |

OTHER PUBLICATIONS

Nicol, Boris, "International Search Report" for PCT/GB2012/050750, as mailed Jul. 11, 2012, 3 pages.

Nicol, Boris, "International Search Report" for PCT/GB2012/050748, as mailed Jul. 11, 2012, 3 pages.

Liquified Gas Handling Principles on Ships and in Terminals; McGuire & White, Third Edition, copyright 2000 (various pages).

* cited by examiner

METHOD OF COOLING BOIL OFF GAS AND AN APPARATUS THEREFOR

TECHNICAL FIELD

This disclosure relates to a method for the cooling, particularly the re-liquefaction, of a boil off gas (BOG) from a liquefied cargo, such as liquefied petroleum gas (LPG), on a floating transportation vessel, and an apparatus therefor.

BACKGROUND OF THE DISCLOSURE

Floating transportation vessels, such as liquefied gas carriers and barges, are capable of transporting a variety of cargoes in the liquefied state. In the present context, these liquefied cargoes have boiling points of greater than −110° C. when measured at 1 atmosphere and include liquefied petroleum gas, liquefied petrochemical gasses such as propylene and ethylene and liquefied ammonia. Liquefied petroleum gas is a useful fuel source, such as for heating appliances and vehicles, as well as being a source of hydrocarbon compounds. LPG comprises one or more of propane, n-butane and i-butane, and optionally one or more other hydrocarbons such as propylene, butylenes and ethane.

Petroleum gases can be extracted from natural gas or produced in the refining of crude oil. As a consequence, petroleum gasses normally comprise a plurality of components. It is often desirable to liquefy petroleum gases in a liquefaction facility at or near their source. As an example, petroleum gases can be stored and transported over long distances more readily as a liquid than in gaseous form because they occupy a smaller volume and may not need to be stored at high pressures. Such LPG can be stored at atmospheric pressure if maintained at or below its boiling temperature, such as at −42° C. or below, being the boiling point of the propane component. Alternatively, LPG may be stored at higher temperatures if it is pressurized above atmospheric pressure.

Petrochemical gases such as ethylene and propylene may be present in, or can be synthesized from, petroleum gas or other hydrocarbons. It is often desirable to liquefy petrochemical gases in a liquefaction facility at or near their place of separation or manufacture for similar reasons to the petroleum gases. Liquefied petrochemical gases can be stored at atmospheric pressure if maintained at or below their boiling temperature, such as at −104° C. or below, for ethylene. Alternatively, liquefied petrochemical gases may be stored at higher temperatures if they are pressurized above atmospheric pressure.

The long distance transportation of LPG or other liquefied cargo having a boiling point of greater than −110° C. when measured at 1 atmosphere may be carried out in a suitable liquefied gas carrier, particularly an LPG carrier, such as an ocean-going tanker having one or more storage tanks to hold the liquefied cargo. These storage tanks may be insulated and/or pressurized tanks. During the loading of the tanks and the storage of liquefied cargo such as LPG in the tanks, gas, such as petroleum gas, may be produced due to the evaporation of the cargo. This evaporated cargo gas is known as boil off gas (BOG). In order to prevent the build up of BOG in the tank, a system may be provided on the carrier to re-liquefy the BOG so that it can be returned to the storage tank in a condensed state. This can be achieved by the compression and cooling of the BOG. In many systems, the compressed BOG is cooled and condensed against seawater.

There are many considerations associated with providing systems to re-liquefy boil off gas from such liquefied cargoes in floating transportation vessels. The size of the vessel imposes limitations on the space available for the re-liquefaction system. This can restrict the number and size of the compressor trains. Furthermore, size restrictions may also preclude the use of a closed refrigeration system to cool the condenser for the compressed BOG stream, such that the cooling duty may be supplied by seawater. When seawater is used, the re-liquefaction system is generally designed to operate with seawater temperatures at up to 32° C.

Liquefied cargoes such as those comprising primarily propane, particularly commercial grade propane, may further comprise relatively high concentrations of lighter components, such as ethane. It may not be possible to re-liquefy all the components of the boil off gas from such liquefied cargoes, particularly those comprising lighter components, such as ethane, present in concentrations above 3.5 mol %. Such non-condensed components may then either be returned to the liquefied cargo storage tanks in the gaseous phase, and will build up in the boil off gas in a closed system thereby increasing in concentration over time, or may be vented from the vessel in order to prevent their build up in the boil off gas. The build up or venting of non-condensed cargo components should be avoided. For instance, as the concentration of non-condensed components in the boil off gas increases, the volume of boil off gas which cannot be re-condensed will increase, reducing the effective capacity of the re-liquefaction system. The venting of non-condensed components, which may be greenhouse gases, is both environmentally and commercially undesirable.

Liquefied cargoes comprising lower boiling point components, such as those with boiling points in the range of from greater than −110° C. to −55° C. when measured at 1 atmosphere, such as the petroleum gas ethane, which may be present as a component in natural gas liquids (NGLs), and the petrochemical gas ethylene, pose particular re-liquefaction problems. For instance, seawater may be unable to provide sufficient cooling duty to re-liquefy the ethane or ethylene component of BOG. In addition the re-liquefaction of such BOG components may require greater compression (e.g. compared to the re-liquefaction of higher boiling point components such as propane).

Typically the re-liquefaction of ethylene requires a compression system capable of compressing the ethylene BOG to a pressure of approximately 51 bar, such as a compression system comprising three or more stages, and a cooling medium at a temperature of 9.5° C. or below in order to condense the compressed BOG stream.

A need exists to provide an improved method of cooling, particularly re-liquefying, boil off gas from a liquefied cargo having a boiling point of greater than −110° C. when measured at 1 atmosphere and comprising a plurality of components in a floating transportation vessel. In particular, a method which provides improved cooling, particularly re-liquefaction, of lighter components of the cargo is desirable.

SUMMARY

The present disclosure utilises a method of heat exchanging a cooled vent stream, which may comprise non-condensed boil off gas components, with a compressed, cooled and then expanded BOG stream. In this way, a further cooled vent stream is provided in which previously non-condensed components may be re-liquefied and subsequently returned to the liquefied cargo tank in the liquid phase. The compressed, cooled and then expanded BOG stream provides a source of increased cooling duty compared to heat exchange media such as seawater, allowing the re-liquefaction of lighter components in the cooled vent stream.

Thus, for a given number of stages of compression, the method and apparatus disclosed herein allows liquefied cargoes to be transported having an increased content of lighter components such as ethane, without the need to add additional stages of compression or vent non-condensed components. Viewed in another way, the method and apparatus described herein allow the extension of a compression system having a given number of stages of compression to cargoes having components which could not normally be re-liquefied.

Furthermore, after the heat exchange between the compressed, cooled and then expanded BOG stream and the cooled vent stream, the resulting BOG stream can be passed to the suction of a stage of compression to re-liquefy the BOG which may have vaporized during the heat exchange.

The method and apparatus disclosed herein are also advantageous for cargoes comprising components of similar molecular weight to non-condensable gas(es) such as nitrogen which can build up in the boil off gas. The method and apparatus can reduce the loss of the cargo component during operations to remove the non-condensable gas(es).

In a first aspect, there is provided a method of cooling a boil off gas stream from a liquefied cargo in a floating transportation vessel, said liquefied cargo having a boiling point of greater than −110° C. at 1 atmosphere and comprising a plurality of components, said method comprising at least the steps of:

compressing a boil off gas stream from said liquefied cargo in two or more stages of compression comprising at least a first stage and a final stage to provide a compressed BOG discharge stream, wherein said first stage of compression has a first stage discharge pressure and said final stage of compression has a final stage suction pressure and one or more intermediate, optionally cooled, compressed BOG streams are provided between consecutive stages of compression;

cooling the compressed BOG discharge stream to provide a cooled vent stream and a cooled compressed BOG stream;

expanding, optionally after further cooling, a portion of the cooled compressed BOG stream to a pressure between that of the first stage discharge pressure and the final stage suction pressure to provide an expanded cooled BOG stream;

heat exchanging the expanded cooled BOG stream against the cooled vent stream to provide a further cooled vent stream.

In one embodiment, the heat exchange of the expanded cooled BOG stream against the cooled vent stream further provides an intermediate cooled compressed BOG stream or a BOG recycle stream.

In a further embodiment, the method further comprises the step of:

adding the BOG recycle stream to an intermediate, optionally cooled, compressed BOG stream.

Typically, the first stage of compression will provide a first intermediate compressed BOG stream at its discharge or outlet. This stream, optionally after cooling to provide a cooled first intermediate compressed BOG stream, can be passed to the suction or inlet of a second stage of compression. The second stage of compression may or may not be the final stage of compression.

In one embodiment, if the portion of the cooled compressed BOG stream, optionally after further cooling, is expanded to a pressure between that of the first stage discharge pressure and the second stage suction pressure, the stream resulting from the heat exchange of the expanded cooled BOG stream will be at a pressure appropriate for passing to the suction of the second stage of compression. This stream can be passed to the suction of the second stage of compression directly as a first intermediate cooled compressed BOG stream. Alternatively, the stream, as a BOG recycle stream, can be added to a first intermediate compressed BOG stream to provide a first intermediate cooled compressed BOG stream which can then be passed to the suction of the second stage of compression.

If at least three stages of compression are present in the compression system, the portion of the cooled compressed BOG stream which is expanded, optionally after further cooling, may be expanded to a pressure between that of (i) the first stage discharge pressure and the second stage suction pressure, or (ii) the second stage discharge pressure and the third stage suction pressure. The stream resulting from the heat exchange of the expanded BOG stream may thus be at a pressure appropriate for passing to the suction of either the first stage or the second stage of compression. Option (i) is preferred in order to provide the greater pressure reduction of the cooled compressed BOG stream, thereby producing a greater cooling duty during the heat exchange with the cooled vent stream.

In another embodiment, the method further comprises the steps of:

drawing a portion of the cooled compressed BOG stream to provide a cooled compressed BOG side stream;

expanding the cooled compressed BOG side stream to provide an expanded cooled BOG stream;

heat exchanging the expanded cooled BOG stream against the cooled vent stream to provide the further cooled vent stream.

In yet another embodiment, the method further comprises the step of:

heat exchanging the expanded cooled BOG stream against a portion of the cooled compressed BOG stream to provide a further cooled compressed BOG stream.

Thus, the expanded cooled BOG stream can be heat exchanged against both the cooled vent stream and a portion of the cooled compressed BOG stream. For instance if a shell and tube or shell and coil heat exchanger is used, the expanded cooled BOG stream can be passed to the shell side of the heat exchanger and the cooled vent stream and the portion of the cooled compressed BOG stream may be present in separate cooling tubes or coils.

In an alternative embodiment, the cooled compressed BOG stream may be further cooled prior to drawing a portion of the stream for expansion, thereby providing the cooled compressed BOG side stream as a further cooled compressed BOG side stream. This further cooling may be achieved, for instance, by heat exchanging the cooled compressed BOG stream against an expanded portion of a further cooled compressed BOG stream to provide a further cooled compressed BOG stream. A portion of the further cooled compressed BOG stream is then expanded to provide the expanded, further cooled, compressed BOG side stream for heat exchange against the portion of the cooled compressed BOG stream. It will be apparent that such an expanded, further cooled, compressed BOG side stream may also be used for heat exchange against the cooled vent stream.

In a further embodiment of the method further comprises:

compressing the boil off gas stream in the first stage of compression to provide a first intermediate compressed BOG stream as an intermediate compressed BOG stream;

heat exchanging the expanded cooled BOG stream with the first intermediate compressed BOG stream to provide a cooled first intermediate compressed BOG stream as an intermediate, cooled, compressed BOG stream;

passing the cooled first intermediate compressed BOG stream to the suction of a second stage of compression.

The first intermediate compressed BOG stream can be provided at a first stage pressure. In one embodiment, the pressure reduction of a portion of the cooled compressed BOG stream to provide the expanded cooled BOG stream at the first stage pressure allows the expanded cooled BOG stream to be added to the first intermediate compressed BOG stream in the heat exchange step. The cooled first intermediate compressed BOG stream may thus be a combination of the expanded cooled BOG stream and the first intermediate compressed BOG stream. This may occur in a liquid sub-cooling process.

In another embodiment of the method, the heat exchange with the expanded cooled BOG stream further provides a BOG recycle stream, and the method comprises the further steps of:

compressing the boil off gas stream in the first stage of compression to provide a first intermediate compressed BOG stream as an intermediate compressed BOG stream;

adding the BOG recycle stream to the first intermediate compressed BOG stream to provide a cooled first intermediate compressed BOG stream as an intermediate, cooled, compressed BOG stream;

passing the cooled first intermediate compressed BOG stream to the suction of a second stage of compression.

This embodiment is typical of a flash liquid sub-cooling process.

In a further embodiment, the method comprises the further steps of:

drawing a portion of the cooled compressed BOG stream to provide an additional cooled compressed BOG side stream;

expanding the additional cooled compressed BOG side stream to provide an additional expanded cooled BOG stream;

heat exchanging the additional expanded cooled BOG stream against a portion of the cooled compressed BOG stream to provide a further cooled compressed BOG stream.

This embodiment is of relevance when the heat exchanges between expanded portions of the cooled compressed BOG stream or the cooled vent stream and a portion of the cooled compressed BOG stream are carried out in separate heat exchangers.

In a still further embodiment of the method, the step of heat exchanging the expanded cooled BOG stream with the cooled vent stream further provides a BOG recycle stream. Such an embodiment may occur in a flash liquid sub-cooling process in which an intermediate compressed stream is not present during the heat exchange.

In another embodiment, the method further comprises the steps of:

compressing the boil off gas stream in the first stage of compression to provide a first intermediate compressed BOG stream as an intermediate compressed BOG stream;

heat exchanging the additional expanded cooled BOG stream with the first intermediate compressed BOG stream to provide a cooled first intermediate compressed BOG stream;

adding the cooled BOG recycle stream to the cooled first intermediate compressed BOG stream and passing the resulting stream to the suction of a second stage of compression.

This embodiment is of relevance when the heat exchanges between expanded portions of the cooled compressed BOG stream or the cooled vent stream and a portion of the cooled compressed BOG stream are carried out in separate heat exchangers. The heat exchange with the additional expanded cooled BOG stream may be a liquid sub-cooling process.

In another embodiment of the method, the step of heat exchanging the additional expanded cooled BOG stream against a portion of the cooled compressed BOG stream further provides an additional BOG recycle stream, and said method further comprising the steps of:

compressing the boil off gas stream in the first stage of compression to provide a first intermediate compressed BOG stream as an intermediate compressed BOG stream;

adding the additional BOG recycle stream to the BOG recycle stream to provide a combined BOG recycle stream;

heat exchanging the combined BOG recycle stream with the first intermediate compressed BOG stream to provide a cooled first intermediate compressed BOG stream;

passing the cooled first intermediate compressed BOG stream to the suction of a second stage of compression.

In this embodiment, the heat exchange of the additional expanded cooled BOG stream with a portion of the cooled compressed BOG stream may be a flash liquid sub-cooling process which provides an additional BOG recycle stream. When the heat exchange between the expanded cooled BOG stream and the cooled vent stream is carried out as a flash liquid sub-cooling process in a separate heat exchanger to provide a BOG recycle stream, this stream can be combined with the additional BOG recycle stream to provide a combined BOG recycle stream. The combined BOG recycle stream can then be heat exchanged with the first intermediate compressed BOG stream, for instance by mixing, to provide a cooled first intermediate compressed BOG stream.

In a further embodiment, the method may comprise the further steps of:

expanding the further cooled vent stream to provide an expanded further cooled vent stream;

passing the expanded further cooled vent stream to a storage tank.

The further cooled vent stream may be a partially or fully condensed stream. In the expansion step, the pressure of the further cooled vent stream can be reduced to the pressure of the storage tank, or slightly above this pressure in order to provide fluid flow to the tank.

In another embodiment, the method may comprise the further step of:

separating the further cooled vent stream to provide a vent discharge stream and a cooled vent BOG return stream.

This embodiment may be applied when the further cooled vent stream is a multi-phase stream, for instance comprising a liquid phase of condensed components and a vapour phase of non-condensed components. The separation step may be a gas/liquid separation step in which the vent discharge stream comprises non-condensed components and the cooled vent BOG return stream comprises condensed components.

In an additional embodiment, the method may comprise the further steps of:

expanding the cooled vent BOG return stream to provide an expanded cooled vent BOG return stream;

passing the expanded cooled vent BOG return stream to a storage tank.

In such an expansion step, the pressure of the cooled vent BOG return stream can be reduced to the pressure of the storage tank, or slightly above this pressure in order to provide fluid flow to the tank.

In a further embodiment, the method may comprise the further steps of:

expanding the cooled vent BOG return stream to provide an expanded cooled vent BOG return stream;

heat exchanging the expanded cooled vent BOG return stream against the vent discharge stream to provide a heat exchanged vent BOG return stream, a cooled vent discharge stream and a further vent discharge stream;

expanding the cooled vent discharge stream to provide an expanded cooled vent discharge stream;

passing the heat exchanged vent BOG return stream and the expanded cooled vent discharge stream to a storage tank.

In such expansion steps, the pressure of the cooled vent BOG return stream and the expanded cooled vent discharge stream can be reduced to the pressure of the storage tank, or slightly above this pressure in order to provide fluid flow to the tank.

In another embodiment, the method may comprise the further steps of:

expanding the further cooled compressed BOG stream to provide an expanded cooled BOG return stream;

passing the expanded cooled BOG return stream to a storage tank.

In such an expansion step, the pressure of the further cooled compressed BOG stream can be reduced to the pressure of the storage tank, or slightly above this pressure in order to provide fluid flow to the tank.

In yet another embodiment of the method, the liquefied cargo is LPG, particularly LPG comprising more than 3.5 mol % ethane, more particularly LPG comprising more than 5.0 mol % ethane.

In another embodiment of the method, the compressed BOG discharge stream can be cooled against one or more heat exchange fluid streams, such as a water stream, more particularly a seawater stream, an air stream, more particularly an ambient air stream, and/or a refrigerant stream, such as a propane or propylene stream or a refrigerant blend stream, such as a stream of R404A, which comprises 1,1,1-trifluoroethane, pentafluoroethane and 1,1,1,2-tetrafluoroethane, to provide the cooled compressed BOG stream. Typically, the water stream has a temperature of +36° C. or below, more typically +32° C. or below. Typically, the refrigerant stream has a temperature of −42° C. or below.

In a further embodiment of the method, the stages of compression are the compression stages of a multi-stage compressor.

In a second aspect, there is provided an apparatus to cool a boil off gas stream from a liquefied cargo in a floating transportation vessel, said liquefied cargo having a boiling point of greater than −110° C. at 1 atmosphere and comprising a plurality of components, said apparatus comprising at least:

a compression system to compress a boil off gas stream from a liquefied cargo, said compression system comprising two or more stages of compression comprising at least a first stage and a final stage to provide a compressed BOG discharge stream, wherein intermediate, optionally cooled, compressed BOG streams are provided between consecutive stages of compression, a discharge heat exchanger to cool the compressed BOG discharge stream to provide a cooled vent stream and a cooled compressed BOG stream; one or more vent heat exchangers to heat exchange an expanded, optionally further cooled, portion of the cooled compressed BOG stream, against the cooled vent stream to provide a further cooled vent stream.

In a further embodiment, said apparatus can be present on the floating transportation vessel.

In a further embodiment, the apparatus of the second aspect can be operated using the method of the first aspect.

The apparatus and method disclosed herein are applicable to any floating transportation vessel for a liquefied cargo having a boiling point of greater than −110° C. at 1 atmosphere and comprising a plurality of components, such as an LPG carrier. The apparatus and method disclosed herein may be utilized in floating transportation vessels where the liquefied cargo storage tanks are fully refrigerated to maintain the cargo in liquid phase at approximately atmospheric pressure by lowering the temperature, as well as in those vessels in which the cargo in the storage tanks is maintained in the liquid phase by a combination of reduced temperature and increased pressure versus ambient.

The liquefied cargo may be selected from the group comprising liquefied petroleum gas, liquefied petrochemical gas and liquefied ammonia. The apparatus and method disclosed herein are of particular benefit for a liquefied cargo, such as LPG, comprising light components, particularly ethane or ethylene in a concentration above 3.5 mol %. Advantageously, for compositions with higher concentrations of light components, additional compression stages may not be required for cooling, particularly where condensation of the compressed BOG discharge stream is effected against seawater.

The method and apparatus disclosed herein utilizes two or more stages of compression.

In order to obtain the benefits of the method and apparatus disclosed herein and cool the cooled vent stream, the use of economizers is not required. However, in certain embodiments, heat exchangers such as economizers can be placed between consecutive stages of compression, such as between the first and second stages, to cool the intermediate compressed BOG streams. Where three or more stages of compression are present, heat exchangers to allow the cooling of an intermediate compressed BOG may be provided between the second and final stages of compression. For instance, an economizer can be situated between the second and third, as well as between the first and second stages of compression. In an economizer, an expanded, optionally further cooled, portion of the cooled compressed BOG stream can be heat exchanged with an intermediate compressed BOG stream. In a further embodiment, an expanded, optionally further cooled, portion of the cooled compressed BOG stream can be heat exchanged with an optionally further cooled portion of the cooled compressed discharge stream. This leads to further improvements in the coefficient of performance and increased cooling, particularly re-liquefaction, capacity.

It will be apparent that the method and apparatus disclosed herein can be applied to an existing floating transportation vessel as a retro-fit, by maintaining the number of stages of compression present and adding the necessary piping, valves and controls to carry out the heat exchange of an expanded cooled BOG stream against a cooled vent stream to provide a further cooled vent stream and optionally an intermediate, cooled, compressed BOG stream or a BOG recycle stream.

As used herein, the term "multiple stages of compression" defines two or more stages of compression in series in a compression system. Each stage of compression may be achieved by one or more compressors. The one or more compressors of each compression stage may be independent from those of the other stages of compression, such that they are driven separately. Alternatively, two or more of the stages of compression may utilize compressors which are linked, typically powered by a single driver and drive shaft, with optional gearing. Such linked compression stages may be part of a multi-stage compressor.

The method and apparatus disclosed herein requires at least two stages of compression. After the first stage of compression, each subsequent stage provides an increased pressure compared to the pressure at the discharge of a previous stage. The term "consecutive stages" refers to pairs of adjacent stages of compression i.e. a stage (n) and the next (n+1) stage where 'n' is a whole number greater than 0. Consequently, consecutive stages are, for instance, first and second stages or second and third stages or third and fourth stages. Intermediate compressed streams (and cooled intermediate compressed streams) refer to those streams connecting consecutive stages of compression. The terms "next stage of compression" or "subsequent stage of compression" used in relation to the cooled intermediate compressed stream refer to the numerically higher number (and higher pressure stage) of the two consecutive stages defining the intermediate stream.

The heat exchange steps may be indirect, where the two or more streams involved in the heat exchange are separated and not in direct contact. Alternatively, the heat exchange may be direct, in which case the two or more streams involved in the heat exchange can be mixed, thereby producing a combined stream.

Other aspects, features, and advantages will become apparent from the following detailed description when taken in conjunction with the accompanying drawings, which are a part of this disclosure and which illustrate, by way of example, principles of any inventions disclosed.

DESCRIPTION OF THE FIGURES

The accompanying drawings facilitate an understanding of the various embodiments.

DETAILED DESCRIPTION

Shipboard LPG re-liquefaction systems based on the open cycle refrigeration principle draw LPG vapour, also known as boil off gas, from one or more storage tanks and pass the boil off gas to a compressor in which it is compressed such that the compressed vapour can be cooled and condensed using sea water as the heat sink/refrigerant. Those lighter components of the compressed vapour which cannot be condensed against sea water are usually vented to the atmosphere or recycled to the storage tanks in vapour form. Typically, the LPG is kept in the storage tank under one or both of reduced temperature (versus ambient) and increased pressure (versus atmospheric).

Figure 1:
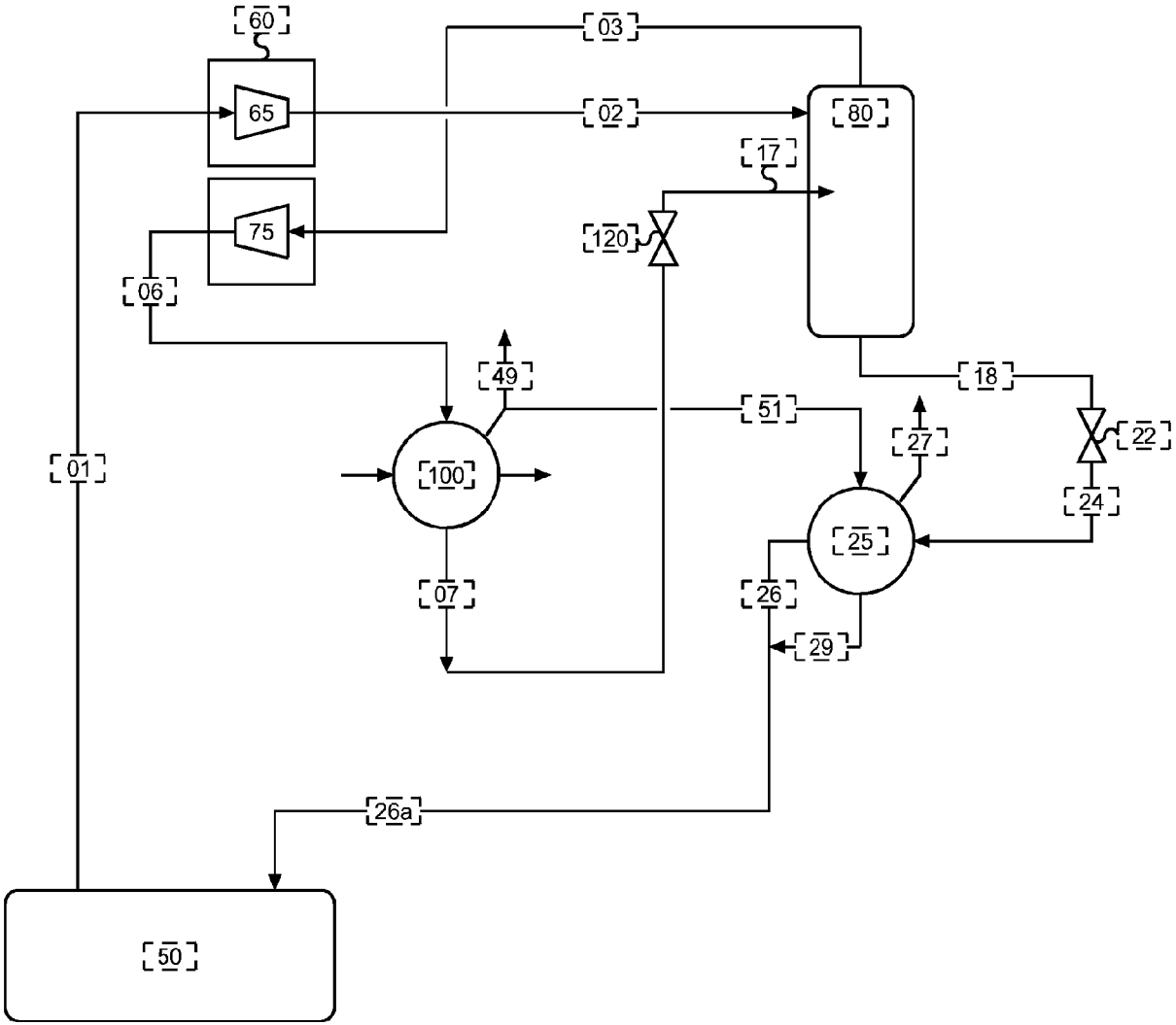
FIG. 1 shows a schematic diagram of one possible known system of re-liquefying boil off gas from a cargo tank in an LPG carrier.

FIG. 1 shows a schematic diagram of a known system for re-liquefying boil off gas in a LPG carrier vessel. Liquefied petroleum gas (LPG) is stored in a tank 50 which may be insulated and/or pressurized in order to maintain the petroleum gas in a liquefied state. Vaporization of the LPG in the tank, for instance due to imperfect thermal insulation, will result in the formation of petroleum gas in the overhead space of the tank 50. In order to prevent the build-up of this gas, it is removed from the tank 50 as a boil off gas stream 01. As many of the components as possible of the removed boil off gas are normally compressed and cooled, to condense them before it is returned to the tank 50.

The boil off gas stream 01 can be passed to a compression system 60, such as the two stage compressor shown in FIG. 1 which comprises a first compression stage 65 and a second compression stage 75. The two-stage compressor 60 produces a compressed BOG discharge stream 06 which can be passed to a condenser 100, in which the compressed BOG discharge stream 06 is cooled against seawater. The condenser 100 produces a cooled compressed discharge stream 07 and a warmed seawater stream (not shown). The cooled compressed discharge stream 07 is a condensed stream comprising those components of the boil off gas capable, at the outlet pressure of the second stage of compression 75, of re-liquefaction against seawater.

The non-condensed components which are incapable of re-liquefaction against seawater are removed from the condenser 100 as a cooled vent stream 51, which is a vapour stream. The cooled vent stream of non-condensed components can be vented to the atmosphere, after expansion to atmospheric pressure, via atmospheric vent stream 49.

The cooled compressed discharge stream 07 can be passed to a first discharge stream pressure reduction device 120, such as an expander or Joule-Thomson valve, where it is expanded to provide an expanded cooled discharge stream 17. The expanded cooled discharge stream 17 can then be passed to a first stage heat exchanger 80, to provide a cooled return fluid stream 18, which is typically a fully condensed stream.

The cooled return fluid stream 18 may then be passed to a return pressure reduction device 22, such as an expander or Joule-Thomson valve, to provide an expanded cooled return fluid stream 24. Typically, the return pressure reduction device 22 will reduce the pressure of the cooled return fluid stream 18 from at or near the pressure of the first intermediate compressed BOG stream 02 to a pressure close to that of the LPG and BOG in the tank 50, such as a pressure just above that of the BOG in the tank which is sufficient to ensure an adequate flow of the expanded cooled return fluid stream 24 to the tank 50. The pressure of the expanded cooled return fluid stream 24 is below that of the discharge pressure of the first stage 65 of compression.

Before return to the tank 50, the expanded cooled return fluid stream 24 can be heat exchanged with the cooled vent stream 51 in heat exchanger 25 to provide a heat exchanged return fluid stream 26. The heat exchange may be sufficient to condense components of the cooled vent stream 51 to provide a condensed vent stream 29 and a non-condensed vent stream 27. The non-condensed vent stream 27 can be expanded to ambient pressure and vented to the atmosphere. The condensed vent stream 29 can be added to the heat exchanged return fluid stream 26 to provide a combined heat exchanged return fluid stream 26*a* which can be passed to storage tank 50.

Returning to compression system 60, the first stage 65 of compression provides a first intermediate compressed BOG stream 02, which is passed to first stage heat exchanger 80. The first intermediate compressed BOG stream 02 can be heat exchanged against the expanded cooled discharge stream 17 in the first stage heat exchanger 80 to provide a cooled first intermediate compressed BOG stream 03, which is a vapour stream. It will be apparent that the first discharge stream pressure reduction device 120 should reduce the pressure of the cooled compressed discharge stream 17 to at or near that of the first intermediate compressed BOG stream 02. The cooled compressed discharge stream 17 and the first intermediate compressed BOG stream 02 are mixed in the shell side of the first stage heat exchanger 80.

The cooled first intermediate compressed BOG stream 03 can then be passed to the suction of the second stage 75 of compression. The second stage 75 compresses the cooled first intermediate compressed BOG stream 03 to provide the compressed BOG discharge stream 06.

The method and apparatus disclosed herein seeks to provide an improved method and apparatus of re-liquefying BOG. An embodiment of the method and apparatus according to the present disclosure is given in FIG. 2. Where appropriate, identical stream and component names and reference numerals to that of FIG. 1 have been used for corresponding streams and components in the remaining Figures.

Figure 2:
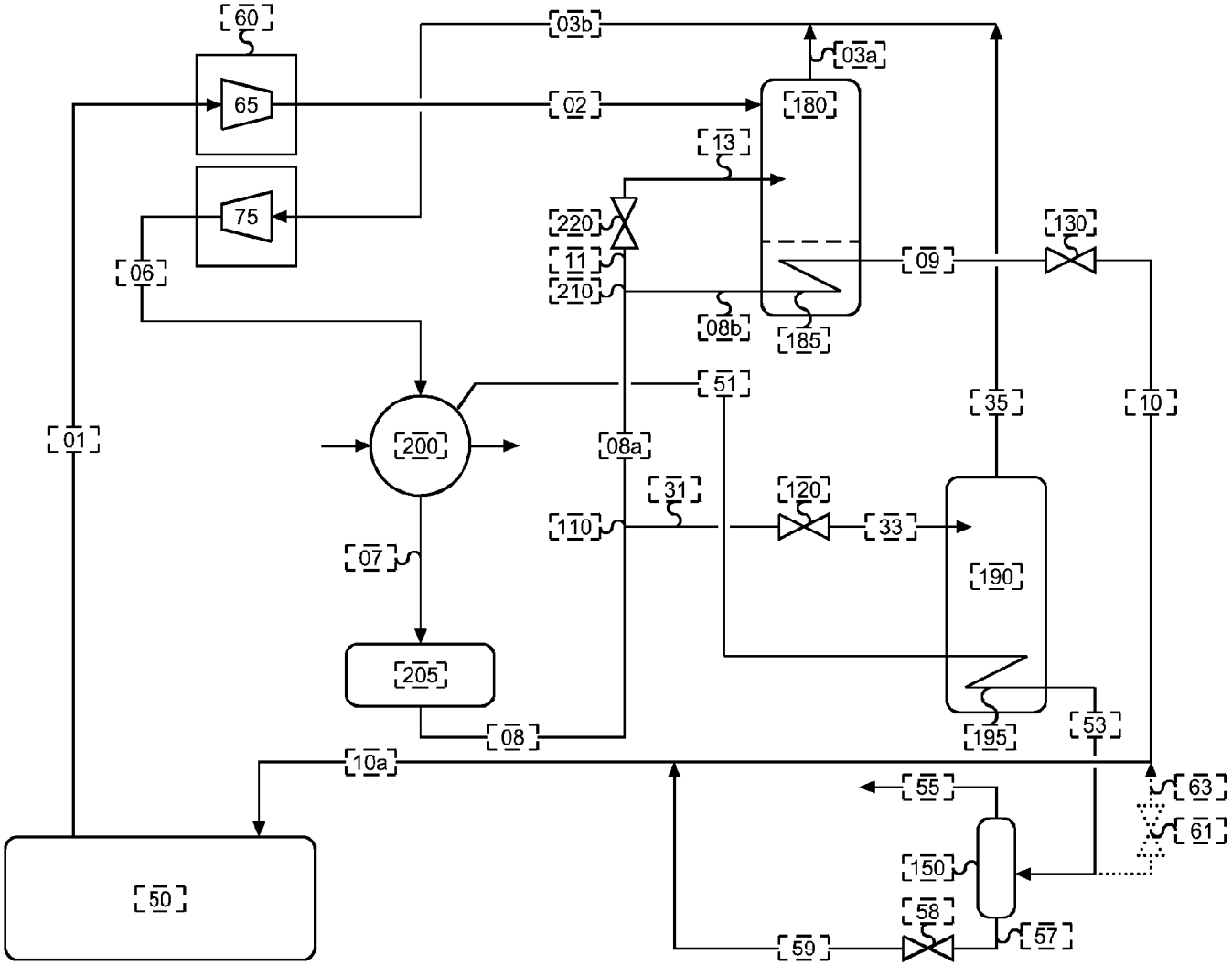
FIG. 2 shows a schematic diagram of a system of cooling, particularly re-liquefying, boil off gas from a liquefied cargo in a floating transportation vessel in accordance with this disclosure.

FIG. 2 shows a liquefied cargo storage tank 50 in a floating transportation vessel, such as an LPG carrier. The liquefied cargo may be LPG and the boil off gas may be petroleum gas. The petroleum gas may comprise propane and ethane. In order to cool, particularly re-liquefy, evaporated cargo from the storage tank 50, a boil off gas stream 01, comprising evaporated cargo, is passed to a compression system 60 having two or more stages of compression. The boil off gas stream 01 may have a pressure (the "BOG pressure") in the range of from above 0 to 500 kPa gauge. The compression system 60 may be a multi-stage compressor comprising two or more stages. By "multi-stage compressor" it is meant that each compression stage in the compressor is driven by the same drive shaft. Alternatively, the compression system 60 may comprise independently driven compressors for each of the stages of compression. When the compression system 60 is a multi-stage compressor, it is typically a reciprocating compressor.

The embodiment of FIG. 2 shows a compression system 60 having a first stage 65 and a second stage 75, which is the final stage of compression, although the method and apparatus described herein is also applicable to compressors having three or more stages. The first stage 65 and second stage 75 of compression provide low and high pressure streams respectively at their discharge.

The compression system 60 compresses the boil off gas stream 01 to provide a compressed BOG discharge stream 06. The compressed BOG discharge stream 06 may have a pressure (the "final stage pressure") in the range of from 1.5 to 2.5 MPa. The compressed BOG discharge stream 06 can be passed to a discharge stream heat exchanger 200, such as a condenser. The compressed BOG discharge stream 06 is cooled against a heat exchange fluid, such as seawater, to provide a cooled compressed discharge stream 07 and warmed heat exchange fluid (not shown). Typically, the seawater used as the heat exchange fluid would have a temperature of +36° C. or below, more typically +32° C. or below.

The cooled compressed discharge stream 07 is typically a partially, more typically a fully condensed, compressed discharge stream. The cooled compressed discharge stream 07 comprises those components of the boil off gas which can be condensed against the heat exchange fluid at the discharge pressure of the final stage of compression. If the discharge stream heat exchanger 200 is a shell and tube heat exchanger, the non-condensed components of the compressed BOG discharge stream 06 can exit the heat exchanger as cooled vent stream 51. Cooled vent stream 51 is typically a gaseous stream comprising those components of the boil off gas which cannot be condensed against the heat exchange fluid at the discharge pressure of the final stage of compression.

The cooled compressed discharge stream 07 is typically passed to a discharge receiver 205 before being discharged as cooled compressed BOG stream 08. Discharge receiver 205 may be an accumulator and can operate to maintain a liquid seal in the discharge heat exchanger 200 and/or maintain the discharge pressure at the final stage 75 of compression.

Figure 6:
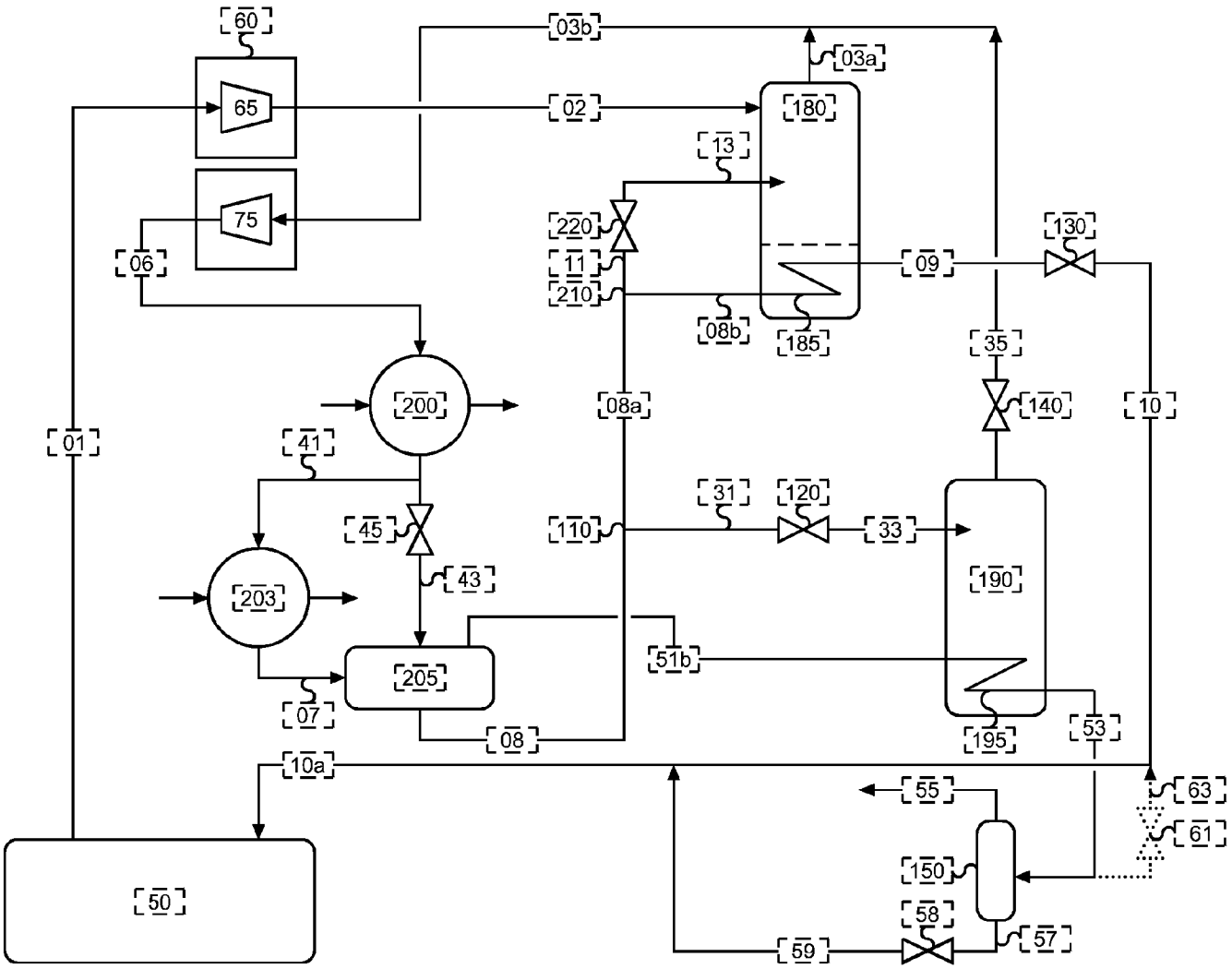
FIG. 6 shows a schematic diagram of a system for cooling, particularly re-liquefying, boil off gas from a liquefied cargo in a floating transportation vessel in accordance with this disclosure.

In an embodiment not shown in FIG. 2, the cooled vent stream may be produced by discharge receiver 205, rather than the discharge heat exchanger 200. This would occur, for instance, if the discharge heat exchanger was of a type which could not adequately separate vapour and condensed phases into separate streams, such as a plate-type heat exchanger. Such a line-up is shown in the embodiment of FIG. 6.

The cooled compressed BOG stream 08 is typically further cooled. This can be achieved by passing the cooled compressed BOG stream 08 to one or more further heat exchangers 180. Further heat exchanger 180 may be of any type, and an intermediate stage, particularly first stage, economizer for cooling the intermediate BOG streams as well as the cooled compressed stream 08 is shown in FIG. 2. This is discussed in more detail below.

The cooled vent stream 51 can be passed to a vent heat exchanger 190, where it is heat exchanged against a portion of the cooled compressed BOG stream 08. In the embodiment shown in FIG. 2, a first discharge stream splitting device 110 divides the cooled compressed BOG stream 08 into a continuing cooled compressed discharge stream 08*a* and a cooled compressed BOG side stream 31. The cooled compressed BOG side stream 31 can be passed to a first discharge stream pressure reduction device 120, such as an expander or Joule-Thomson valve, where it is expanded to provide an expanded cooled BOG stream 33, which can then be heat exchanged against the cooled vent stream 51 to provide a further cooled vent stream 53 and a BOG recycle stream 35. Typically, this heat exchange is carried out by injecting the expanded cooled BOG stream 33 into the shell side of the vent heat exchanger 190, with the cooled vent stream 51 present in one or more vent heat exchanger coils 195 within the shell of the vent heat exchanger 190.

In an embodiment not shown in FIG. 2, the stream providing the cooling duty to the vent heat exchanger 190 may be drawn as a side stream from the further cooled compressed BOG stream 09, and then expanded to an intermediate stage pressure, such as the first stage pressure. The origin of the further cooled compressed BOG stream 09 is discussed below. In such an embodiment, the first discharge stream splitting device could be provided in the further cooled compressed BOG stream 09, rather than in the cooled compressed BOG stream 08. The side stream which is then expanded to an intermediate stage pressure would therefore be a further cooled compressed BOG side stream. This can then be expanded to provide an expanded further cooled compressed BOG stream, which can be heat exchanged against the cooled vent stream 51.

The BOG recycle stream 35 produced in the vent heat exchanger 190 is typically a vapour stream. It will be apparent that if the cooled compressed BOG side stream 31 is expanded to a pressure at or slightly above that provided by the discharge of the first stage 65 of compression, namely the first stage pressure, then the BOG recycle stream 35 produced from the heat exchange of the expanded cooled compressed BOG stream 33 can be passed to an intermediate compressed BOG stream linking the first and second stages of compression, such as the first intermediate compressed BOG stream 03*a*. By passing the BOG recycle stream 35 to the compression system 60, this stream can be recompressed and cooled, typically condensed, as part of the method described herein. Thus, the further cooling of the cooled vent stream is achieved without an increase in boil off gas vapour being returned to the cargo storage tank 50.

The further cooling of the cooled vent stream 51 in the vent heat exchanger 190 can condense a portion of the components of the boil off gas which could not be condensed in the discharge heat exchanger 200 against the heat exchange fluid such as seawater. The further cooled vent stream 53 is typically an at least partly condensed stream. The further cooled vent stream 53 can be passed to a vent stream pressure reduction device 61 (dashed line), such as a Joule-Thomson valve or expander, where its pressure is reduced to provide an expanded further cooled vent stream 63 (dashed line). The expanded further cooled vent stream 63 may have a pressure at or slightly above the pressure of the liquefied cargo storage tank 50, so that it can be returned to the tank, for instance by addition to expanded cooled BOG return stream 10 to provide combined expanded cooled BOG return stream 10*a*.

In another embodiment shown in FIG. 2, the further cooled vent stream 53 can be passed to a vent stream separator 150, such as a gas/liquid separator. The vent stream separator 150 provides a vent discharge stream 55, which is typically a vapour stream, and a cooled vent BOG return stream 57, which is typically a condensed stream, more typically a sub-cooled stream, comprising those components of the boil off gas which were condensed in the vent heat exchanger 190. The pressure of the vent discharge stream 55 may be reduced, for instance to a pressure appropriate for return to the storage tank 50, for storage elsewhere or for venting.

The cooled vent BOG return stream 57 may be passed through a vent return stream pressure reduction device 58, such as a Joule-Thomson valve or expander, to provide an expanded cooled vent BOG return stream 59. The expanded cooled vent BOG return stream 59 is typically a condensed stream. The expanded cooled vent BOG return stream 59 can be passed to the storage tank 50, for instance by addition to the expanded cooled BOG return stream 10.

In a further embodiment not shown in FIG. 2, an additional heat exchange step can be carried out to cool the vent discharge stream 55, for instance to condense one or more components of this stream against an expanded portion of the cooled vent BOG return stream 57. In particular, the cooled vent BOG return stream 57 can be passed to a vent return stream pressure reduction device 58 to provide an expanded cooled vent BOG return stream 59, typically at or just above the pressure of the storage tank 50.

The expanded cooled vent BOG return stream 59 can then be passed to a further vent heat exchanger, where it can be heat exchanged, typically indirectly, against the vent discharge stream 55. The expanded cooled vent BOG return stream 59 can be warmed to provide a heat exchanged vent BOG return stream in the further vent heat exchanger. The vent discharge stream 55 can be cooled to provide a cooled vent discharge stream and a further vent discharge stream. The cooled vent discharge stream is typically a condensed stream comprising one or more condensed components. The further vent discharge stream is typically a vapour stream comprising one or more non-condensed components.

If the further vent heat exchanger is of the shell and tube type, then the cooled vent discharge stream and the further vent discharge stream can exit as different streams. If the further vent heat exchanger cannot separate streams of different phases, then the stream resulting from the cooling of the vent discharge stream 55 can be passed to a further vent stream separator, such as a gas/liquid separator, which can produce the cooled vent discharge stream and the further vent discharge stream.

The pressure of the further vent discharge stream may be reduced, for instance to a pressure appropriate for return to the storage tank 50, for storage elsewhere or for venting. The cooled vent discharge stream can be passed to a further vent stream pressure reduction device, where it can be expanded to provide an expanded cooled vent discharge stream, typically at or just above the pressure of the storage tank 50. The heat exchanged vent BOG return stream and the expanded cooled vent discharge stream can then be passed to storage tank 50.

Returning to the cooled compressed BOG stream 08, this can be cooled against an expanded portion of the cooled compressed BOG stream in a first further heat exchanger 180. In the embodiment shown in FIG. 2, a second discharge stream splitting device 210 divides the continuing cooled compressed BOG stream 08*a* into a further continuing cooled compressed BOG stream 08*b* and an additional cooled compressed BOG side stream 11. The additional cooled compressed BOG side stream 11 can be passed to an second discharge stream pressure reduction device 220, such as an expander or Joule-Thomson valve, where it is expanded to provide an additional expanded cooled BOG stream 13, which can then be heat exchanged against the further continuing compressed BOG stream 08*b* to provide a further cooled compressed BOG stream 09, which may be a sub-cooled stream.

The first further heat exchanger 180, may be a shell and tube or shell and coil heat exchanger in which the further continuing cooled compressed BOG stream 08*b* is passed through one or more first further heat exchanger tubes or coils 185 (coils are shown in FIG. 2) in which it is cooled against the additional expanded cooled BOG stream 13 injected into the shell side of the first heat exchanger. The additional cooled compressed BOG side stream 11 can be expanded to a pressure close to the pressure of the discharge of the first stage of the multi-stage compressor.

In a further embodiment not shown in FIG. 2, the second discharge stream splitting device 210 can be provided downstream of the first further heat exchanger 180, such that the fluid providing the cooling duty in the first further heat exchanger 180 is obtained by the expansion of a portion of the further cooled compressed BOG stream 09, rather than the expansion of a portion of the continuing cooled compressed BOG stream 08*a*.

In a similar manner to the scheme of FIG. 1, the further cooled compressed BOG stream 09 can then be passed to a return BOG pressure reduction device 130, such as an expander or Joule-Thomson valve, to provide an expanded cooled BOG return stream 10, which may be a sub-cooled condensed BOG return stream. This can then be returned to the storage tank 50.

Returning to the first further heat exchanger 180, as well as cooling further continuing compressed BOG stream 08*b*, it can also cool intermediate compressed streams from the first compressor stage 65. In such an embodiment, the first further heat exchanger 180 can be an economizer. This heat exchange can lead to an increased coefficient of performance.

In particular, the boil off gas stream 01 can be compressed by first stage 65 to a first intermediate compressed BOG stream 02 at a first stage pressure. The first intermediate compressed BOG stream 02 can then be heat exchanged against the additional expanded further cooled BOG stream 13 to provide a cooled first intermediate compressed BOG stream 03*a*. This heat exchange can be carried out in first further heat exchanger 180, which is typically a first intermediate stage economizer. When the first intermediate stage economizer is of the shell and tube type, the first intermediate compressed BOG stream 02 and the additional expanded further cooled BOG side stream 13 can both be injected into the shell-side of the heat exchanger. This is known as liquid sub-cooling. During the heat exchange process, these streams will mix such that the cooled first intermediate compressed BOG stream 03*a* will be a combination of these streams. It will be apparent that the additional further cooled compressed BOG side stream 11 should therefore be expanded to a pressure at or slightly above that provided by the discharge of the first stage 65, namely the first stage pressure. This will provide an acceptable pressure balance within the first further heat exchanger 180.

The BOG recycle stream 35 from the vent heat exchanger 190 can be added to the cooled first intermediate compressed BOG stream 03*a* to provide a combined cooled first intermediate compressed BOG stream 03*b*. The combined cooled first intermediate compressed BOG stream 03*b* can then be passed to the suction of the second and final stage 75 of the compression system 60, where it is compressed to provide the compressed BOG discharge stream 06 at a second, and in this embodiment final stage, pressure.

In a further embodiment not shown in FIG. 2, the first intermediate compressed BOG stream 02, rather than being passed to the first further heat exchanger 180, can be passed to the vent heat exchanger 190. This can provide a different split of cooling duty between the first further heat exchanger 180 and the vent heat exchanger 190. In this case, the first intermediate compressed BOG stream would be heat exchanged with the expanded cooled BOG stream 33, and the combined stream produced would be a cooled first intermediate compressed BOG stream, which could be passed to the suction of the second stage 75 of compression. Consequently, the first further heat exchanger, rather than producing a cooled first intermediate compressed BOG stream, would produce an overhead expanded cooled discharge stream, which could also be passed to the suction of the second stage 75 of compression, for instance by adding it to the cooled first intermediate compressed BOG stream.

In an alternative embodiment of the method and apparatus disclosed herein, rather than the use of liquid sub-cooling in which the discharge vapour from the first compressor stage 75 is passed into the first further heat exchanger 180 where it mixes with the vapour before being passed to the suction of the next stage of the compressor as shown in FIG. 2, a flash liquid sub-cooling process may be used. In the flash liquid sub-cooling process, the discharge vapour from the first compressor stage is not passed through the first further heat exchanger, but is mixed with the vapour produced in the heat exchanger at or before the suction to the next stage of the compression cycle.

Thus, the first intermediate compressed BOG stream 02, is not passed through the first further heat exchanger 180 as it is in the embodiment of FIG. 2, but is heat exchanged with the stream, such as an overhead expanded cooled discharge stream, which is typically a vapour stream, produced in the first further heat exchanger 180 from the additional expanded cooled BOG stream 13. This heat exchange can be achieved by mixing the two streams and should occur at or before the suction to the second stage 75 of the compression cycle.

Figure 3:
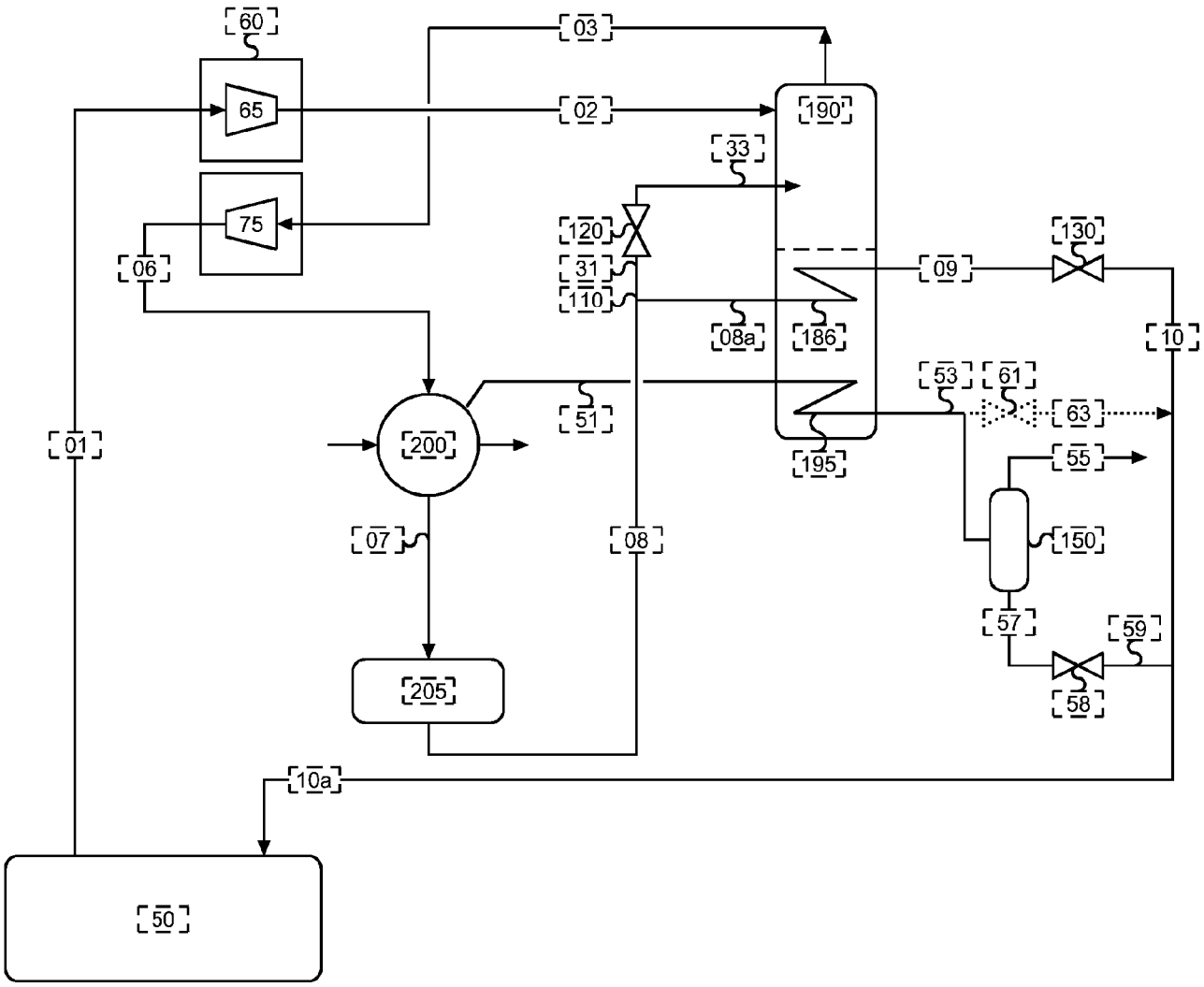
FIG. 3 shows a schematic diagram of a system for cooling, particularly re-liquefying, boil off gas from a liquefied cargo in a floating transportation vessel in accordance with this disclosure.

FIG. 3 shows a further embodiment of the method and apparatus disclosed herein. The compression system 60 comprises two stages of compression, a first stage 65 and a second stage 75 which is a final stage, in a similar manner to the embodiment of FIG. 3. The first and second stages 65 and 75 may be two stages of a multi-stage compressor.

The embodiment of FIG. 3 differs from that of FIG. 2 in that the two heat exchangers 180, 190 have been combined into a single vent heat exchanger 190'. Reducing the number of heat exchangers in the cooling apparatus may be beneficial because of the limited availability of space on the vessel.

The cooled compressed BOG stream 08 is provided in an identical manner to the embodiment of FIG. 2. It is passed to a first discharge stream splitting device 110 where it is split into a continuing cooled compressed BOG stream 08*a* and a cooled compressed BOG side stream 31. The cooled compressed BOG side stream 31 can be passed to a first discharge stream pressure reduction device 120, such as an expander or Joule-Thomson valve, where it is expanded to provide an expanded cooled BOG stream 33. The expanded cooled BOG stream 33 can then be heat exchanged against the cooled vent stream 51, the first intermediate compressed stream 02 and the continuing cooled compressed BOG stream 08*a* in the vent heat exchanger 190'.

In the embodiment of FIG. 3, a shell and coil heat exchanger is shown. Alternatively, a shell and tube heat exchanger may be used. The expanded cooled BOG stream 33 can be injected into the shell side of the vent heat exchanger 190', where it is heat exchanged against (i) the cooled vent stream 51 present in one or more vent heat exchanger coils 195 and (ii) the continuing cooled compressed BOG stream 08*a* in one or more compressed BOG stream coils 186 within the shell of the heat exchanger. The cooled vent stream 51 and the continuing cooled compressed BOG stream 08*a* are therefore maintained separate from the expanded cooled BOG stream 33.

The first intermediate compressed stream 02 may also be injected into the shell side of the vent heat exchanger 190 where it can be heat exchanged with the expanded cooled BOG stream 33, typically by mixing the two fluid streams.

The cooled vent stream 51 is cooled in the vent heat exchanger 190' to provide a further cooled vent stream 53. In this way, further cooling of the cooled vent stream 51 against an expanded portion of the cooled compressed BOG stream is achieved, reducing its temperature below that which could have been achieved by cooling against a heat exchange fluid such as seawater in discharge heat exchanger 200. The further cooled vent stream 53 can be expanded and passed back to the storage tank 50, or sent to vent stream separator 150 as discussed in the embodiment of FIG. 2.

The further cooled compressed BOG stream 09 provided by vent heat exchanger 190' can be passed through the return BOG pressure reduction device 130 where it can be expanded to the storage pressure of the storage tank 50 or slightly above this pressure to allow the flow of the expanded cooled return stream 10 to the tank.

The mixing of the expanded cooled BOG stream 33 with the first intermediate compressed stream 02 in the vent heat exchanger 190' provides a cooled first intermediate compressed stream 03. The cooled first intermediate compressed stream 03 can be passed to the suction of the second stage 75 of compression to provide compressed BOG discharge stream 06.

In the embodiment of FIG. 3, vent heat exchanger 190' functions as an economizer. This provides an efficient way of integrating the various heat exchange processes in a liquid sub-cooling process. However, it is not a requirement of the method and apparatus disclosed herein that heat exchange must be carried out in an economizer. Any heat exchanger or exchangers which facilitate at least the heat exchange of an expanded portion of the cooled compressed BOG stream against the cooled vent stream 51 could be used.

For instance, it is not necessary to pass the first intermediate compressed stream 02 to the vent heat exchanger 190'. Instead, the expanded cooled BOG stream 33 can be heat exchanged with the cooled vent stream 51 and continuing cooled compressed BOG stream 08*a* in the vent heat exchanger 190' in a flash liquid sub-cooling process. The stream resulting from the heat exchange of the expanded cooled BOG side stream 33 can be withdrawn from the vent heat exchanger 190' as a BOG recycle stream. The BOG recycle stream can then be heat exchanged with the first intermediate compressed BOG stream 02 to provide a cooled first intermediate compressed BOG stream 03. This can be achieved by adding the BOG recycle stream to the first intermediate compressed BOG stream 02, thereby mixing the two streams.

Figure 4:
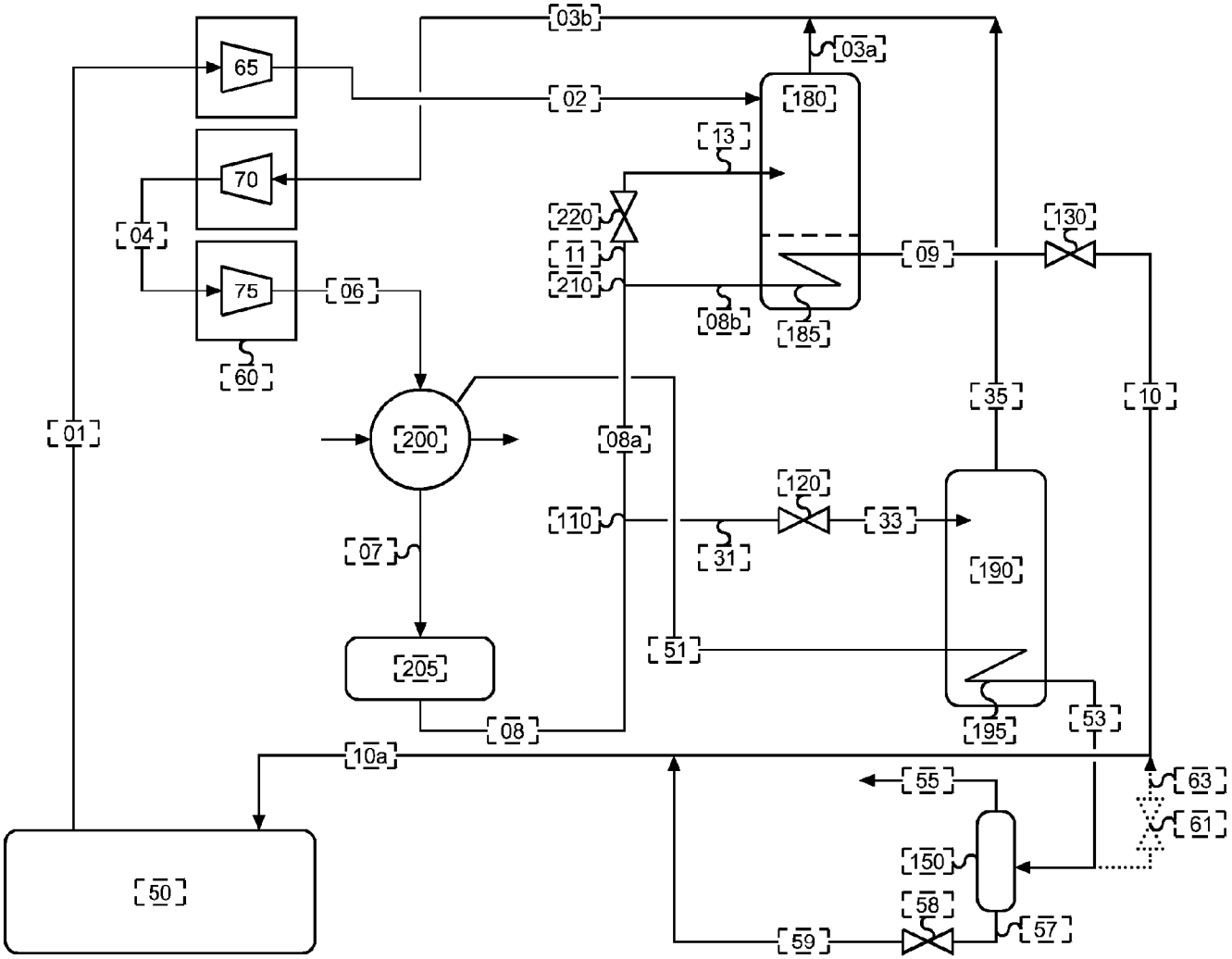
FIG. 4 shows a schematic diagram of a system for cooling, particularly re-liquefying, boil off gas from a liquefied cargo in a floating transportation vessel in accordance with this disclosure.

FIG. 4 shows a further embodiment in which the method and apparatus disclosed herein is applied to a compression system 60 comprising three stages of compression, a first stage 65, a second stage 70 and a third and final stage 75. The first, second and third stages 65, 70 and 75 produce low, intermediate and high pressure streams respectively. The first stage 65 compresses boil off gas stream 01 to provide a first intermediate compressed BOG stream 02 at a first stage pressure.

In this embodiment, the second stage of compression 70, rather than providing compressed BOG discharge stream 06, provides a second intermediate compressed stream 04 at a second stage pressure. The second intermediate compressed stream 04 can be passed to the suction of a third stage 75 of compression. Third stage 75 produces a compressed BOG discharge stream 06 which is passed to discharge stream heat exchanger 200. The remaining streams, and their interactions, operate as described for the embodiment of FIG. 2.

In a further embodiment not shown in FIG. 4, it is possible to also heat exchange the second intermediate compressed BOG stream 04, prior to passing it to the suction of the third stage 75 of compression. For instance, a portion of the cooled compressed stream 08 can be expanded to the second stage pressure, and heat exchanged against the second intermediate compressed BOG stream 04 to provide a cooled second intermediate compressed stream, which can then be passed to the third stage 75 of compression, and a further cooled compressed stream. The heat exchange can be carried out by adding an expanded portion of the cooled compressed stream 08 to the second intermediate compressed stream 04. This heat exchange may be carried out in a second further heat exchanger. The second further heat exchanger can also be used to cool one or both of the cooled vent stream 51 and a portion of the cooled compressed BOG stream 08, to provide a liquid sub-cooling process.

Alternatively, a portion of the cooled compressed stream 08 can be expanded to the second stage pressure and then heat exchanged against one or both of the cooled vent stream 51 and a portion of the cooled compressed BOG stream 08 in a flash liquid sub-cooling process in a second further heat exchanger. The stream resulting from the heat exchange of the expanded cooled BOG stream can then be heat exchanged with the second intermediate compressed BOG stream 04, for instance by mixing and the combined streams passed to the suction of the third stage 75 as a cooled second intermediate compressed BOG stream.

FIG. 6 shows a further embodiment of the method and apparatus disclosed herein, disclosing a modification of the embodiment of FIG. 2. The compression system 60 comprises two stages of compression, a first stage 65 and a second stage 75, which is a final stage, in a similar manner to the embodiment of FIG. 2. The first and second stages 65 and 75 may be two stages of a multi-stage compressor.

The embodiment of FIG. 6 is particularly advantageous for liquefied cargo comprising lower boiling point components, typically ethane or ethylene, which may be present either as the major component of the liquefied cargo (e.g. that component accounting for the highest proportion in the liquefied cargo by mol %) or as minor component (i.e. in a lesser proportion than the major component).

For instance, ethane may be present as a minor component of natural gas liquid cargoes, which may further comprise propane or butane as major components. Ethylene may be present as the major component in ethylene cargoes, which, if of polymer grade may comprise at least 99.9 mol %, more typically at least 99.95 mol % ethylene, with the balance being impurities such as nitrogen.

Ethylene has a boiling point below −103° C. at a pressure of 1 atmosphere, considerably lower than a petroleum gas such as propane. Consequently, the re-liquefaction of ethylene BOG requires, compared to the re-liquefaction of a propane BOG, a higher discharge pressure at the final stage of compression and/or a heat exchange fluid stream capable of providing a lower temperature than seawater.

The provision of a higher discharge pressure at the final stage of compression would typically require three or more stages of compression. The present embodiment is beneficial because it can provide a reduction in the quantity of valuable cargo which is not re-liquefied and remains in the vent discharge stream 55, even when only two stages of compression are utilized.

The compressed BOG discharge stream 06 is provided in an identical manner to the embodiment of FIG. 2. In particular, the compressed BOG discharge stream 06 is provided at the discharge of compression system 60. The compressed BOG discharge stream 06 can be passed to a discharge stream heat exchanger 200. The compressed BOG discharge steam 06 can be cooled against a first heat exchange fluid (not shown), such as seawater, in discharge heat exchanger 200 to provide a heat exchanged compressed discharge stream 41. Typically, seawater is used as the first heat exchange fluid. The seawater may have a temperature of +36° C. or below, more typically +32° C. or below.

In contrast to the embodiment of FIG. 2, the stream exiting the discharge stream heat exchanger 200 is typically an uncondensed stream, such as an uncondensed ethylene stream, rather than a partially or fully condensed stream. This is because if the first heat exchange fluid is seawater, it is difficult to provide sufficient cooling duty to condense the compressed BOG discharge stream 06 at the discharge pressure of second stage 75 of the compression system 60. Consequently, a further heat exchange step can be carried out to provide cooled compressed discharge stream 07, typically as a partially, more typically as a fully condensed, compressed discharge stream.

In particular, the heat exchanged compressed discharge stream 41 can be cooled against a second heat exchange fluid, in a second heat exchange fluid heat exchanger 203, to provide the cooled compressed discharge stream 07. The second heat exchange fluid may be a refrigerant, such as propylene or propane, ammonia or refrigerant blends such as R-404A. The second heat exchange fluid may be at a temperature of −42° C. or below, prior to the heat exchange with the heat exchanged compressed discharge stream 41. The refrigerant may be provided by a refrigerant pack (not shown), for instance a refrigerant system comprising refrigerant compressor, refrigerant driver, second heat exchange fluid heat exchanger 203 and refrigerant heat exchanger, such as a refrigerant condenser. The refrigerant may be cooled, typically condensed, against sea water in the refrigerant heat exchanger. The refrigerant system is typically a closed refrigerant system. Typically, a cargo is not used as the refrigerant i.e. the refrigerant system does not comprise a cargo re-liquefaction system.

In an alternative embodiment not shown in FIG. 6, the compressed BOG discharge stream 06 can be at least partially, typically fully condensed in compressed discharge stream heat exchanger 200, to directly provide cooled compressed discharge stream 07. This may occur when the first heat exchange fluid is a refrigerant, such as propane or propylene. Thus, a heat exchange step against seawater and the requirement for a further heat exchange step against a second heat exchange fluid would not be necessary. However, it will be apparent that the refrigerant system would have to be sized to provide a sufficient cooling duty to the compressed BOG discharge stream 06 without the seawater pre-cooling, particularly de-superheating, of the embodiment of FIG. 6.

The cooled compressed discharge stream 07 is typically passed to a discharge receiver 205 before exiting as cooled compressed BOG stream 08. Discharge receiver 205 may be an accumulator and can operate to maintain a liquid seal in the second heat exchange fluid heat exchanger 203 and/or maintain the discharge pressure at the final stage 75 of compression.

Those components of the cooled compressed discharge stream 07 which are not condensed by the heat exchange steps can be separated from the condensed components and withdrawn as cooled vent stream 51*b*. In contrast to the embodiment of FIG. 2, the cooled vent stream 51*b* can be drawn from discharge receiver 205. This would occur, for instance, if the second heat exchange fluid heat exchanger 203 is of a type which could not adequately separate vapour and condensed phases into separate streams, such as a plate-type heat exchanger. The cooled vent stream 51*b* can then be treated in a similar manner to the cooled vent stream 51 of the embodiment of FIG. 2.

In an alternative embodiment (not shown), if the second heat exchange fluid heat exchanger 203 is a shell and tube heat exchanger, the non-condensed components can be separated from the condensed components within the heat exchanger to provide the cooled vent stream directly from the second heat exchange fluid heat exchanger.

FIG. 6 further shows a second heat exchanger bypass stream 43, downstream of a second heat exchanger bypass pressure reduction device 45, typically a control valve. Second heat exchanger bypass stream 43 passes the first heat exchanged discharge stream 41 directly to the discharge receiver 205. The bypass stream can be used during the start-up of the cooling method and apparatus.

FIG. 6 further shows the presence of a BOG recycle stream pressure regulating device 140 in BOG recycle stream 35, exiting vent heat exchanger 190. The BOG recycle stream pressure regulating device 140 allows the regulation of the pressure within the vent heat exchanger 190. By controlling the shell-side pressure of the vent heat exchanger 190, the temperature of the expanded cooled BOG stream 33 can be controlled, thereby controlling the temperature of the further cooled vent stream 53 produced by heat exchanging the expanded cooled BOG stream 33 against the cooled vent stream 51*b*. The temperature of the further cooled vent stream 53 can determine the relative proportion of its components which are separated into the vent discharge stream 55 and the cooled vent BOG return stream 57, produced by passing further cooled vent stream 53 to vent stream separator 150.

It has surprisingly been found that using the BOG recycle stream pressure regulating device 140, particularly to increase the shell side pressure of the vent heat exchanger 190, for instance by approximately 3 bar, not only reduces the mass flow rate of the vent discharge stream 55 (i.e. the mass flow rate of cargo which is not re-liquefied), but also reduces the proportion of hydrocarbons in this stream, such as ethylene, compared to other non-condensable components which may be present such as nitrogen.

Nitrogen may be present in BOG, because it was present in the liquefied cargo, and/or because it was present in the storage tank or pipework as a residue from an inerting process carried out prior to the loading. The method of this embodiment may advantageously reject a disproportionally high amount of nitrogen, compared to that of the valuable cargo components, such as ethane or ethylene, in the vent discharge stream 55.

EXAMPLE

The example examines the advantages of the method disclosed herein for both two-stage and three-stage compressors. Hypothetical calculations of the refrigeration capacity versus ethane content of a liquefied propane cargo were carried out in a system whereby cooled vent streams of non-condensed components from a discharge heat exchanger are cooled against a portion of the cooled compressed BOG stream expanded to the first stage pressure, thereby reducing or eliminating the necessity to recycle non-condensed components back to the cargo storage tanks or to vent same to atmosphere.

Compression system data was based on two-stage and three-stage compressors supplied by Burckhardt Compression AG of Winterthur, Switzerland. The equilibrium vapour compositions corresponding to the liquid phase compositions indicated in the example were calculated using the Peng Robinson Stryjek-Vera equations of state.

Figure 5:
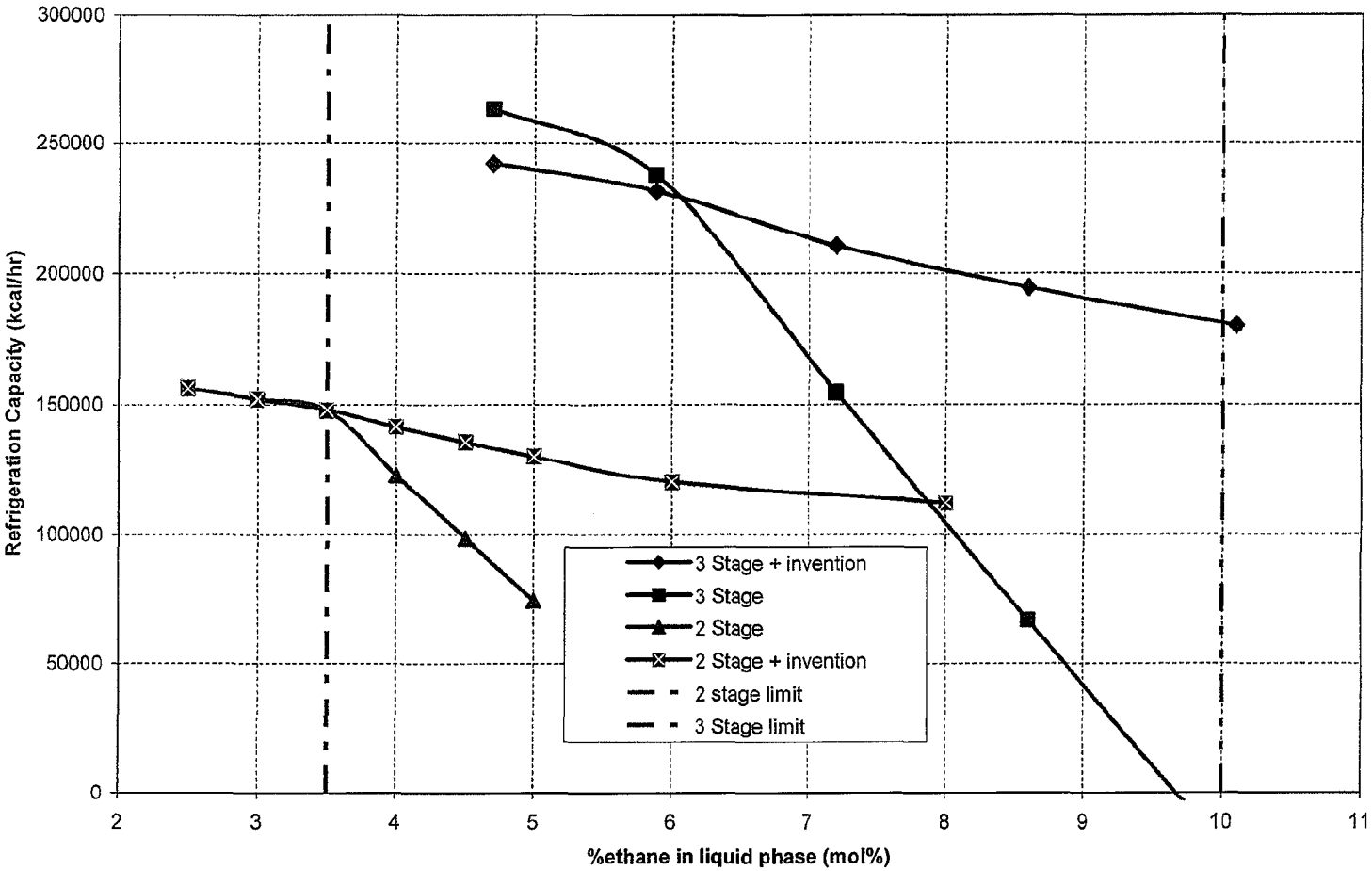
FIG. 5 shows a schematic diagram of refrigeration capacity versus the concentration of ethane in mol % of a liquefied cargo, in which the balance is provided by propane, for liquefaction systems comprising 2 and 3 stages of compression, compared to the corresponding systems in accordance with this disclosure.

The results of the analysis are shown in FIG. 5. The vertical lines indicated as "2 stage limit" and "3 stage limit" relate to the mechanical limits of the respective compressors in terms of the maximum final discharge pressure relative to the pressure required to effect cooling and/or condensation of the equilibrium vapour corresponding to the liquid phase composition at a condensing temperature of +40° C. This condensing temperature is obtainable using seawater at +32° C. as a heat exchange fluid.

The 2 stage compressor has a mechanical limit, equivalent to a discharge pressure of 20 bar absolute, that equates to a liquid phase composition of around 3.5 mole % ethane. At or below this composition, the 2 stage compressor can compress the equilibrium vapour such that it can be fully condensed. At compositions above 3.5 mole % ethane, the curve indicated as "2 stage" and denoted by the symbol ▲ represents the effective reduction in capacity of the re-liquefaction system due to the recycling or venting of non-condensed vapour. The curve indicated as "2 stage+ invention" and denoted by the symbol ■ containing an "x" represents the increased vapour phase composition that can be handled by the same re-liquefaction system with the method disclosed herein incorporated. The area between the curves is representative of the increased range of operation in respect of percentage ethane in the liquid phase that can be handled with a two-stage compressor operating under the method disclosed herein, obviating the need to install a three-stage compressor.

The three-stage compressor has a mechanical limit that equates to a liquid phase composition of around 10.0 mole % ethane. At or below this composition, the three-stage compressor can compress the equilibrium vapour such that it can be fully condensed.

For the simulation of the three-stage compressor shown, the discharge pressure was restricted to 24 bar absolute. The curve indicated as "3 stage" and denoted by the symbol ■ represents the effective reduction in capacity of the re-liquefaction system, particularly at ethane concentrations beyond 6.0 mole %, due to the recycling or venting of non-condensed vapour. The curve indicated as "3 stage+ invention" and denoted by the symbol ♦ represents the increased vapour phase composition that can be handled by the same re-liquefaction system with the method disclosed herein incorporated. The area between the curves is representative of the increased range of operation in respect of percentage ethane in the liquid phase that can be handled with a three-stage compressor operating under the method disclosed herein, obviating the need to install a four-stage compressor.

The person skilled in the art will understand that the any invention disclosed herein can be carried out in many various ways without departing from the scope of the appended claims. For instance, an invention may encompass the combination of one or more of the optional or preferred features disclosed herein.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The invention claimed is:

1. A method of cooling a boil off gas stream from a liquefied cargo in a floating transportation vessel, said liquefied cargo having a boiling point of greater than −110° C. at 1 atmosphere and comprising a plurality of components, said method comprising at least the steps of:

compressing a boil off gas (BOG) stream from said liquefied cargo in two or more stages of compression comprising at least a first stage and a final stage to provide a compressed BOG discharge stream, wherein said first stage of compression has a first stage discharge pressure and said final stage of compression has a final stage suction pressure and one or more intermediate, optionally cooled, compressed BOG streams are provided between consecutive stages of compression;

cooling and separating the compressed BOG discharge stream to provide a cooled vent stream as a gaseous stream comprising non-condensed components of the boil off gas and a cooled compressed BOG stream comprising condensed components of the boil off gas;

expanding, optionally after further cooling, a portion of the cooled compressed BOG stream to a pressure between that of the first stage discharge pressure and the final stage suction pressure to provide an expanded cooled BOG stream;

heat exchanging the expanded cooled BOG stream against the cooled vent stream to provide a further cooled vent stream, wherein the heat exchange of the expanded BOG stream against the cooled vent stream further provides an intermediate, cooled, compressed BOG stream or a BOG recycle stream; and adding the BOG recycle stream to an intermediate, optionally cooled, compressed BOG stream.

2. The method of claim 1 further comprising the steps of:

expanding the further cooled vent stream to provide an expanded further cooled vent stream;

passing the expanded further cooled vent stream to a storage tank.

3. The method of claim 1 further comprising the step of:

separating the further cooled vent stream to provide a vent discharge stream and a cooled vent BOG return stream.

4. The method of claim 3 further comprising the steps of:
expanding the cooled vent BOG return stream to provide an expanded cooled vent BOG return stream; and
passing the expanded cooled vent BOG return stream to a storage tank.

5. The method of claim 3 further comprising the steps of:
expanding the cooled vent BOG return stream to provide an expanded cooled vent BOG return stream;
heat exchanging the expanded cooled vent BOG return stream against the vent discharge stream to provide a heat exchanged vent BOG return stream, a cooled vent discharge stream and a further vent discharge stream; and
expanding the cooled vent discharge stream to provide an expanded cooled vent discharge stream;
passing the heat exchanged vent BOG return stream and the expanded cooled vent discharge stream to a storage tank.

6. The method of claim 1, wherein the liquefied cargo is liquid petroleum gas (LPG) comprising more than 3.5 mol % ethane.

7. The method of claim 1, wherein the compressed BOG discharge stream is cooled against one or more heat exchange fluid streams to provide the cooled compressed BOG stream, wherein the heat exchange fluid streams are selected from the group consisting of a water stream, a seawater stream, an air stream, an ambient air stream and a refrigerant stream.

8. The method of claim 1, wherein the two or more stages of compression are compression stages of a multi-stage compressor.

9. The method of claim 1, wherein the step of cooling and separating the compressed BOG discharge stream comprises:
cooling the compressed BOG discharge stream against a heat exchange fluid in a shell and tube heat exchanger to provide a warmed heat exchange fluid, the cooled vent stream and a cooled compressed discharge stream, the cooled compressed discharge stream comprising condensed components of the boil off gas, and passing the cooled compressed discharge stream to a discharge receiver which discharges the cooled compressed discharge stream; or
cooling the compressed BOG discharge stream in a plate-type heat exchanger to provide a cooled compressed discharge stream and separating the cooled compressed discharge stream in a discharge receiver to provide the cooled vent stream and the cooled compressed BOG stream.

10. A method of cooling a boil off gas stream from a liquefied cargo in a floating transportation vessel, said liquefied cargo having a boiling point of greater than −110° C. at 1 atmosphere and comprising a plurality of components, said method comprising at least the steps of:
compressing a boil off gas (BOG) stream from said liquefied cargo in two or more stages of compression comprising at least a first stage and a final stage to provide a compressed BOG discharge stream, wherein said first stage of compression has a first stage discharge pressure and said final stage of compression has a final stage suction pressure and one or more intermediate, optionally cooled, compressed BOG streams are provided between consecutive stages of compression;
cooling and separating the compressed BOG discharge stream to provide a cooled vent stream as a gaseous stream comprising non-condensed components of the boil off gas and a cooled compressed BOG stream comprising condensed components of the boil off gas;
expanding, optionally after further cooling, a portion of the cooled compressed BOG stream to a pressure between that of the first stage discharge pressure and the final stage suction pressure to provide an expanded cooled BOG stream;
heat exchanging the expanded cooled BOG stream against the cooled vent stream to provide a further cooled vent stream;
drawing a portion of the cooled compressed BOG stream to provide a cooled compressed BOG side stream; expanding the cooled compressed BOG side stream to provide an expanded cooled BOG stream; and heat exchanging the expanded cooled BOG stream against the cooled vent stream to provide the further cooled vent stream.

11. The method of claim 10 further comprising the step of:
heat exchanging the expanded cooled BOG stream against a portion of the cooled compressed BOG stream to provide a further cooled compressed BOG stream.

12. The method of claim 11 further comprising the steps of:
expanding the further cooled compressed BOG stream to provide an expanded cooled BOG return stream; and
passing the expanded cooled BOG return stream to a storage tank.

13. The method of claim 10 further comprising:
compressing the boil off gas stream in the first stage of compression to provide a first intermediate compressed BOG stream as an intermediate compressed BOG stream;
heat exchanging the expanded cooled BOG stream with the first intermediate compressed BOG stream to provide a cooled first intermediate compressed BOG stream as an intermediate, cooled, compressed BOG stream; and
passing the cooled first intermediate compressed BOG stream to the suction of a second stage of compression.

14. The method of claim 10, wherein the heat exchange with the expanded cooled BOG stream further provides a BOG recycle stream, said method comprising the further steps of:
compressing the boil off gas stream in the first stage of compression to provide a first intermediate compressed BOG stream as an intermediate compressed BOG stream;
adding the BOG recycle stream to the first intermediate compressed BOG stream to provide a cooled first intermediate compressed BOG stream as an intermediate, cooled, compressed BOG stream; and
passing the cooled first intermediate compressed BOG stream to the suction of a second stage of compression.

15. The method of claim 10 comprising the further steps of:
drawing a portion of the cooled compressed BOG stream to provide an additional cooled compressed BOG side stream;
expanding the additional cooled compressed BOG side stream to provide an additional expanded cooled BOG stream; and
heat exchanging the additional expanded cooled BOG stream against a portion of the cooled compressed BOG stream to provide a further cooled compressed BOG stream.

16. The method of claim 15, wherein the step of heat exchanging the expanded cooled BOG stream with the cooled vent stream further provides a BOG recycle stream.

17. The method of claim 16, further comprising the steps of:

compressing the boil off gas stream in the first stage of compression to provide a first intermediate compressed BOG stream as an intermediate compressed BOG stream;

heat exchanging the additional expanded cooled BOG stream with the first intermediate compressed BOG stream to provide a cooled first intermediate compressed BOG stream; and adding the cooled BOG recycle stream to the cooled first intermediate compressed BOG stream and passing a resulting stream to the suction of a second stage of compression.

18. The method of claim 16, wherein the step of heat exchanging the additional expanded cooled BOG stream against a portion of the cooled compressed BOG stream further provides an additional BOG recycle stream, said method further comprising the steps of:

compressing the boil off gas stream in the first stage of compression to provide a first intermediate compressed BOG stream as an intermediate compressed BOG stream;

adding the additional BOG recycle stream to the BOG recycle stream to provide a combined BOG recycle stream;

heat exchanging the combined BOG recycle stream with the first intermediate compressed BOG stream to provide a cooled first intermediate compressed BOG stream; and passing the cooled first intermediate compressed BOG stream to the suction of a second stage of compression.

* * * * *